United States Patent [19]

Hübner et al.

[11] 4,352,041

[45] Sep. 28, 1982

[54] ROTARY ANODES FOR X-RAY TUBES

[75] Inventors: Horst Hübner; Bernhard Lersmacher, both of Aachen; Hans Lydtin, Stolberg; Rolf Wilden, Roetgen, all of Fed. Rep. of Germany

[73] Assignee: U.S. Philips Corporation, New York, N.Y.

[21] Appl. No.: 165,894

[22] Filed: Jul. 3, 1980

[30] Foreign Application Priority Data

Jul. 19, 1979 [DE] Fed. Rep. of Germany ..... 2929136

[51] Int. Cl.[3] ..... H01J 35/08

[52] U.S. Cl. ..... 374/144; 378/125; 378/127; 427/35

[58] Field of Search ..... 313/330, 55, 60, 311; 427/35, 65

[56] References Cited

U.S. PATENT DOCUMENTS 2,863,083 12/1958 Schran ..... 313/330
3,579,022 5/1971 Hennig ..... 313/330
3,890,521 6/1975 Shroff ..... 313/330
4,132,917 1/1979 Bildstein et al. ..... 313/330
4,145,632 3/1979 Devine, Jr. ..... 313/330

*Primary Examiner*—Saxfield Chatmon, Jr.
*Attorney, Agent, or Firm*—Robert J. Kraus

[57] ABSTRACT

An intermediate layer comprising several sub-layers is sandwiched between the support and a target layer of a rotary X-ray anode. The sub-layer of the intermediate layer which contacts the support and the sub-layer of the intermediate layer which contacts the target layer both consist of pure rhenium. Interposed between these two sub-layers is a further sub-layer consisting of a rhenium alloy containing at least one carbide-forming metal, for example tungsten, tantalum or hafnium. This construction of the intermediate layer provides a barrier against carbon diffusion, which barrier has substantially the heat conduction properties of metals and which offers a sufficient protection against the penetration of carbon into the target layer, even at temperaturers above 1500 K.

6 Claims, 2 Drawing Figures

ROTARY ANODES FOR X-RAY TUBES

BACKGROUND OF THE INVENTION

The invention relates to a rotary anode for an X-ray tube, having a support made of carbon, a target layer made of a heavy metal and a rhenium-containing intermediate layer comprising several sub-layers sandwiched between the support and the target layer.

The support of the rotary anode consists, for example, of graphite, particularly electrographite, of pyrolytic graphite or of foamed carbons as described in German Offenlegungsschrift No. 2,453,204 and German Offenlegungsschrift No. 2,648,900. The support may alternatively be composed of sub-elements of these materials, for example electrographite or pyrolytic graphite.

In the literature the target layer is also referred to as the electron bombardment area (DE-PS No. 2,115,896), X-ray active layer, anti-cathode or collision electrode layer (DE-OS No. 2,748,566). It consists of, for example, tungsten, molybdenum, tantalum or alloys of these metals with one another or with rhenium.

AT-PS No. 281,213 corresponding to British Pat. No. 1,247,244 discloses a rotary anode in which a rhenium intermediate layer is arranged between the graphite support and the tungsten or tungsten-alloy target layer. The tungsten alloy can be, for example, a tungsten-osmium or a tungsten-iridium alloy. Diffusion of the graphite into the target layer is almost completely prevented by this intermediate layer. During the investigations which resulted in the invention it was found, however, that, above 1500 K. the desired antidiffusion effect is only obtained for a sufficient period of time with intermediate rhenium layers having a thickness of several tens of μm. Such layers are quite expensive.

In the rotary anode described in DE-OS No. 2,748,566 an intermediate layer containing rhenium and molybdenum is sandwiched between the graphite support and the target layer consisting of tungsten or of a tungsten alloy. The intermediate layer is composed of two sub-layers, the sub-layer which contacts the support containing a large quantity of rhenium, for example 60 to 90% by weight of this sub-layer consists of rhenium, whereas the sub-layer which contacts the target layer contains a large quantity of molybdenum. Molybdenum-containing intermediate layers have indeed a very good adhesion. However, at temperatures above 1500 K. molybdenum combines with the graphite of the support to form molybdenum carbide which has a relatively poor heat conductivity and which furthermore affects the adhesion between the target layer, which, for example, consists of tungsten, and the graphite support, so that the target layer may become wholly detached from the support when it is loaded by an electron beam for a prolonged period of time.

SUMMARY OF THE INVENTION

It is an object of the invention to provide, under the target layer, a barrier to the diffusion of carbon, which barrier has substantially the heat conduction properties of metals and provides adequate protection, even at temperatures above 1500 K., against the penetration of carbon into the target layer.

In accordance with the invention a sub-layer of the intermediate layer which contacts the support and a sub-layer of the intermediate layer which contacts the target layer each consist of pure rhenium and a further sub-layer of a rhenium alloy containing at least one carbide-forming metal is sandwiched between these two sub-layers.

The rhenium alloy preferably contains a total of 1 to 25 mol.% of carbide-forming metals.

Carbide-forming metals are, for example, titanium, zirconium, hafnium, vanadium, niobium, tantalum, chromium, molybdenum, tungsten and some rare earth metals, (U.S. Pat. No. 2,979,813) as well as nickel and iron (German PS No. 896,234).

Preferred rhenium alloys are rhenium alloys containing 1 to 25 mol.% of tungsten or 1 to 5 mol.% of tantalum or 1 to 3 mol.% of hafnium.

The sub-layer of pure rhenium which contacts the support is preferably 1 to 5 μm, particularly 4 μm, thick. The rhenium alloy sub-layer is preferably 1 to 5 μm, more particularly 4 μm thick. The sub-layer of pure rhenium which contacts the target layer is preferably 1 to 3 μm, more particularly 2 μm, thick.

The individual sub-layers of the intermediate layer are produced, for example, by deposition from the gaseous phase. The pure rhenium sub-layers are preferably produced by reducing rhenium halides with hydrogen. When depositing the rhenium alloy sub-layers, gaseous mixtures of rhenium halides and halides of the desired metal additions are reduced with hydrogen.

The multi-layer construction in accordance with the invention has the result that with intermediate layer temperatures below 1500 K.—which is the case for rotary anodes for approximately 80% of the loading period—the diffusion-hampering effect of the pure rhenium sub-layer which contacts the support is suffficient to prevent diffusion of carbon atoms through the intermediate layer. At temperatures above 1500 K.—i.e. for approximately 20% of the loading periods—the carbon atoms diffusing through the above-mentioned sub-layer are trapped by the carbide-forming metals. Owing to the low concentration of carbide-forming metals in the alloy sub-layer of the intermediate layer, the formation of carbides in this sub-layer has hardly any negative effect on the heat conduction or the adhesion. Finally, the rhenium sub-layer adjoining the target layer ensures that the carbon transfer between the carbides in the intermediate layer and the metal, for example tungsten, of the target layer is prevented to a very high extent.

The construction in accordance with the invention of the intermediate layer, which operates as a diffusion barrier and has outer sub-layers of pure rhenium, renders it possible to maintain all the known, good, mechanical properties of rhenium intermediate layers. The efficiency of the multi-sub-layer rhenium intermediate layer is still further improved because the average diffusion coefficient decreases with the progressive carbide formation in the centre part of the sub-layers, which results in a prolonged useful life of the anode.

BRIEF DESCRIPTION OF THE DRAWING

An embodiment of the invention will now be described with reference to the accompanying drawing in which.

DESCRIPTION OF THE PREFERRED EMBODIMENT

Figure 1:
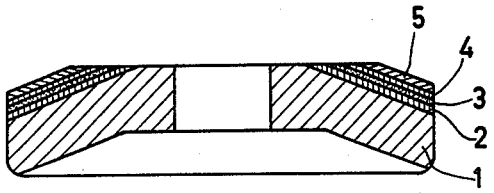
FIG. 1 shows a cross-sectional view of a rotary anode FIG. 2 schematically shows an enlarged cross-section through a sequence of sub-layers which are used as diffusion barriers.
Figure 2:
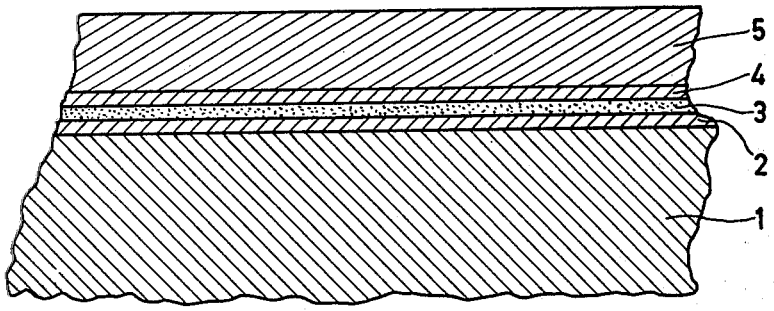

The support 1 consists of electrographite. The metal sub-layers 2 to 5 are applied on the chamfered surface areas of the support of the rotary anode by deposition from the gaseous phase. The rhenium sub-layer 2 is 5 μm thick. The sub-layer 3, which consists of rhenium doped with 5 mol.% tantalum is 4 μm thick. The pure rhenium sub-layer 4 is 2 μm thick and the tungsten target layer 5 is 200 μm thick.

What is claimed is:

1. A rotary anode for an X-ray tube comprising a carbon support, a heavy metal target layer and a plurality of intermediate layers interposed between the support and the target layer, said intermediate layers including first and second outer layers consisting essentially of rhenium, in contact with the support and the target layer, respectively, and an inner layer consisting essentially of a rhenium alloy containing at least one carbide-forming metal, interposed between the first and second outer layers.

2. A rotary anode as claimed in claim 1 characterized in that the alloy of which the inner layer consists contains from 1 to 25 mol.% of carbide-forming metals.

3. A rotary anode as claimed in claim 2, characterized in that the alloy of which the inner layer consists contains 1 to 25 mol.% tungsten or 1 to 5 mol.% tantalum or 1 to 3 mol.% hafnium.

4. A rotary anode as claimed in claim 1, 2 or 3, characterized in that the first layer is 1 to 5 μm thick.

5. A rotary anode as claimed in any of claim 1, 2, 3 or 4, characterized in that the inner layer is 1 to 5 μm thick.

6. A rotary anode as claimed in any of claim 1, 2, 3 or 5, characterized in that the second layer is 1 to 3 μm thick.

* * * * *